United States Patent [19]

Brignoli

[11] Patent Number: 4,671,095

[45] Date of Patent: Jun. 9, 1987

[54] METHOD FOR FORMING WORK-PIECES BY DROP FORGING

[75] Inventor: Silvio Brignoli, Monteggio, Switzerland

[73] Assignee: Eumuco Aktiengesellschaft für Maschinenbau, Leverkusen, Fed. Rep. of Germany

[21] Appl. No.: 724,645

[22] Filed: Apr. 18, 1985

[30] Foreign Application Priority Data

Apr. 21, 1984 [DE] Fed. Rep. of Germany ..... 3415205
Jan. 22, 1985 [DE] Fed. Rep. of Germany ..... 3501911
Mar. 13, 1985 [DE] Fed. Rep. of Germany ..... 3508861

[51] Int. Cl.[4] ..... B21D 43/10

[52] U.S. Cl. ..... 72/403; 72/420; 72/422

[58] Field of Search ..... 72/402, 403, 377, 420, 72/422, 426, 356, 361, 416, 76; 29/563, 34 R

[56] References Cited

U.S. PATENT DOCUMENTS 655,719 8/1900 Lanz ..... 72/420
1,186,145 6/1916 Stowe ..... 72/226
1,885,648 11/1932 Wilcox ..... 72/361
1,996,819 4/1935 Dean ..... 72/426
2,372,507 3/1945 Marsh ..... 72/76
4,008,592 2/1977 Hall et al. ..... 72/106
4,505,144 3/1985 Sakuma et al. ..... 72/361
4,510,789 4/1985 Tomioka et al. ..... 72/420

*Primary Examiner*—Daniel C. Crane
*Attorney, Agent, or Firm*—Neil F. Markva

[57] ABSTRACT

The assembly and the invention accomplishes a method for forging work-pieces by drop forging. The method comprises the steps of providing a blank having a given volume of material corresponding at least to the volume of the work-piece to be produced. The drop forging assembly includes a swage having cooperating swage portions corresponding at least to the length of the work-piece to be produced. The blank is first forged along a predetermined portion of its length between the cooperating swage portions. Then, the remaining section of the blank is transported to the otherside of the same swage and forged between the cooperative swage portions. Devices are provided at either side of the operational faces of the swage so that a continuous movement of blanks, partially forged work-pieces and finished work-pieces may be effected in a continuous manner.

5 Claims, 7 Drawing Figures

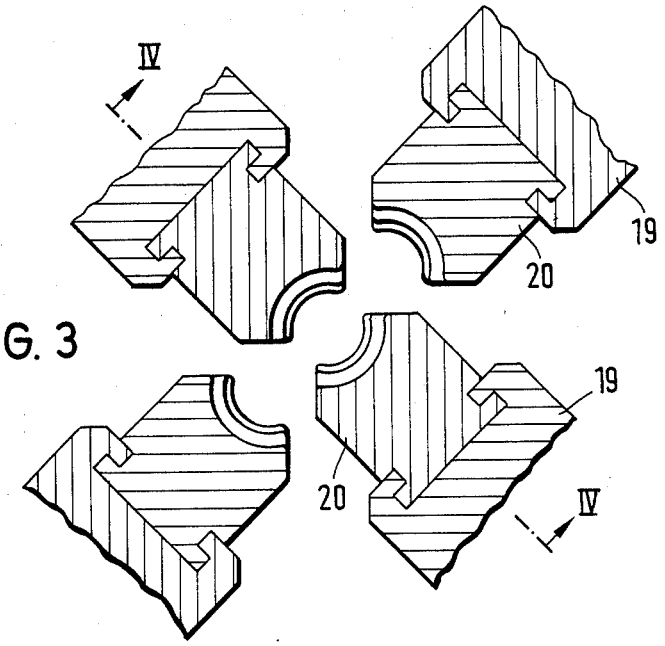
FIG. 3
FIG. 4
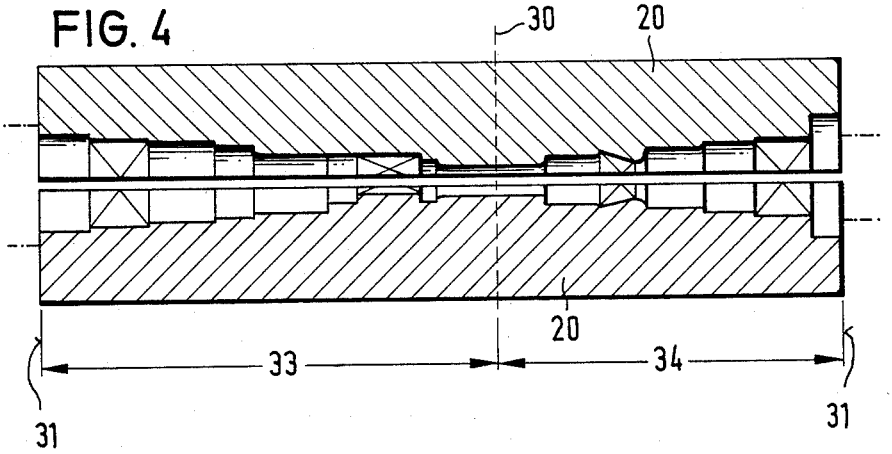

METHOD FOR FORMING WORK-PIECES BY DROP FORGING

FIELD OF THE INVENTION

The invention relates to a method and an apparatus for forming work-pieces by drop forging. The blank of material being forged has a given volume which corresponds at least approximately to the volume of the work-piece to be produced. The length of the forming area of the cooperating swage portions forming the swage corresponds at least to the length of the work-piece to be produced. The blank or slug is drop forged all over, at the same time, or in a diagonal direction partially at the same time and in a peripheral direction in succession.

BACKGROUND OF THE INVENTION

Known drop forging machines or high-speed hammer precision forging machines are disclosed in U.S. Pat. Nos. 3,246,502 and 3,945,237. In these known structures, a slug or blank having a given length is inserted into the swage portions and is worked so that the work-piece is finish-forged when leaving the swage. The forming areas of the swage portions when viewed in the direction of their longitudinal axis are constructed and arranged in such a way that they correspond in each case to the form of the work-piece to be produced. This is true even to form partial forming areas. The slug is supplied from one side of the swage and the finished forged piece is removed from the same side or after it has completely passed through the swage from along the longitudinal axis thereof.

A disadvantage of this method of operation is that in order to hold and guide the work-piece in a satisfactory manner, excess areas of material must exist on the work-pieces so that the work-piece can be grasped with tongs or other suitable grasping device. The end of the work-piece which has been grasped by tongs cannot be forged.

PURPOSE OF THE INVENTION

The primary object of the invention is to provide a method and an assembly for forming work-pieces by drop forging wherein it is possible to effect the operation with relatively no loss with respect to the material while evenly distributing a high level of homogeneity qualitatively over the entire length of the work-piece being produced.

SUMMARY OF THE INVENTION

The method or process of the invention includes the step of forging a predetermined portion of the slug or blank along its longitudinal length within the swage leaving a remaining unforged portion of the slug. Then, the remaining unforged portion is subsequently forged on the other side of the same swage. The slug is supplied for the following forging operation by means of the partial piece of the same slug which has already been forged on a first operational side of the swage. The portion of the blank remaining unforged is advantageously forged during the forging of the first partial piece of a blank newly supplied to the first operational face of the swage.

The assembly of the invention includes a forging machine comprising a swage having at least two swage portions which can be moved in pairs against one another. The swage portions correspond in length to the total length of the work-piece to be made. Viewed in a direction of their longitudinal axis, the swage portions have forming area portions which with regard to a predetermined transverse plane inside the total longitudinal area correspond reciprocally in the case of one of the area portions of the swage before this transverse plane to the form of the work-piece area after the transverse plane and in the case of the swage area portion after the transverse plane to the form of the area of the work-piece before the transverse plane.

Thus, the forming areas of the swage portion viewed in the through-run direction of the material are constructed in such a way that they are shaped in the forward area of their length with respect to the form of the rear work-piece area and in the rear area of their length with respect to the form of the forward work-piece area. The blank may be grasped for purposes of insertion into the same swage on the other operational side of the swage at the forged part once it has been finish-forged on a first partial area thereof. The partially forged slug is then inserted into the swage on the other operational face thereof to produce the finished forged part. Thereafter, the finished forged part can be removed to a storage area.

With handling of this kind, both areas of a work-piece may be forged consecutively in terms of time in different working cycles with the same swage. Consequently, excess material is no longer required on the blank for gripping and holding same. Forging can be carried out with no waste. There is no unprocessed area needed for holding by tongs or other grasping device. Savings in material and operations are achieved. Additionally, a situation is established where the finished work-pieces have good, evenly distributed homogeneity and an assured freedom from burrs.

Any cross-sectional form of the work-pieces can be produced regardless of how often and to what extent individual cross-sectional areas change with respect to the form of their periphery. That is, it is possible to have a work-piece having round or polyhedral shapes with a varied number of edges, symmetrical or unsymmetrical forms with respect to the longitudinal central axis and/or with regard to their dimensions. The work-piece can have manifold variations in cross-section along its length.

The distribution of the partial lengths along which the work-piece is formed depends on the shaping of the work-piece as a whole and presents a problem in terms of method techniques. The transverse plane to be determined for the distribution of the forming areas in the longitudinal direction will only lie in the center in special cases and in most cases will lie off center of the work-piece. In terms of forging techniques, the transverse plane will be arranged in the portion of the greatest diameter of the work-piece or in the portion having the smallest diameter of the swage.

In accordance with another feature of the invention, guide slides are disposed at each operational face of the swage. The guide slides on either side of the swage are shifted longitudinally with respect to the swage. The slide for taking up the unprocessed slug or blank has an axial stop for the blank at the end of the receiving bore hole therein. The slide for taking up the partially forged blank includes a stop located at the beginning of the receiving bore hole.

In a further aspect of the assembly of this invention, a transport slide is arranged parallel to the guide slides at a distance from the drop forging machine. The transport slide includes a gripping device for gripping the unfinished forge portion from a first operational face of the swage and transferring same to the other operational face of the swage on the other side of the forging machine. Thus, the transport slide moves into different directions. The transport slide includes a supporting arm carrying the gripping device and being adjustable cross-wise with respect to the shifting direction of the transport slide. Consequently, it becomes possible in a simple and reliable manner to transport the partially forged work-piece from one face of the swage to the other face thereof. The movements of the transport device are carried out in synchronized cycles.

BRIEF DESCRIPTION OF DRAWINGS

Other objects of this invention will appear in the following description and claims, reference being made to the accompanying drawings forming a part of the specification wherein like reference characters designate corresponding parts in the several views.

FIG. 3 is a fragmentary view diagrammatically showing the swage portions which work together in pairs in accordance with the invention;

FIG. 4 is a sectional view through the swages along line IV—IV of FIG. 3;

FIGS. 5, 6 and 7 are elevational views of two examples of the construction of a work-piece forged according to the invention.

DETAILED DESCRIPTION

Figure 1:
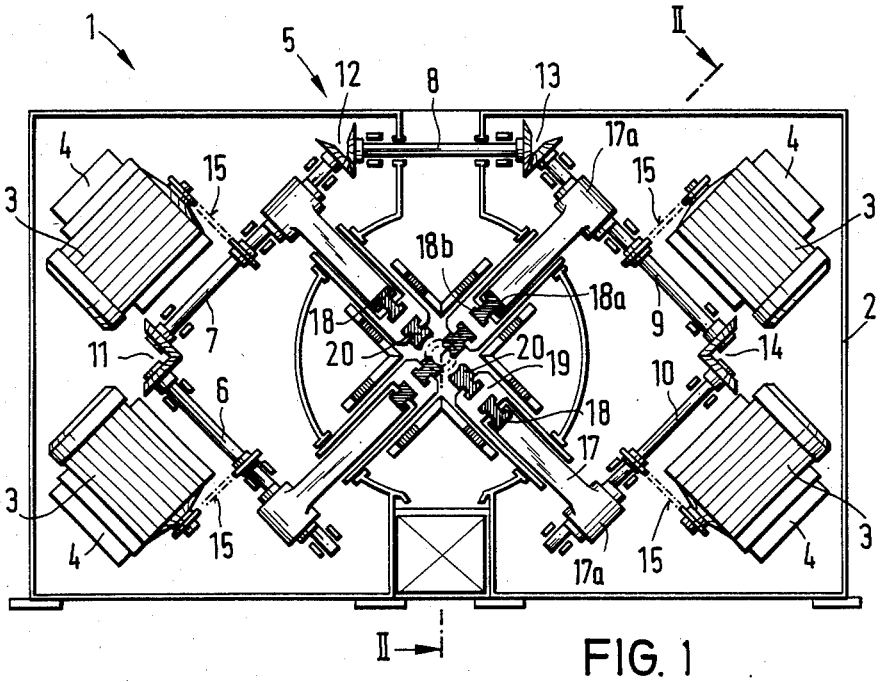
FIG. 1 is a top elevational view diagrammatically showing a high-speed hammer drop forging machine of the invention.
Figure 2:
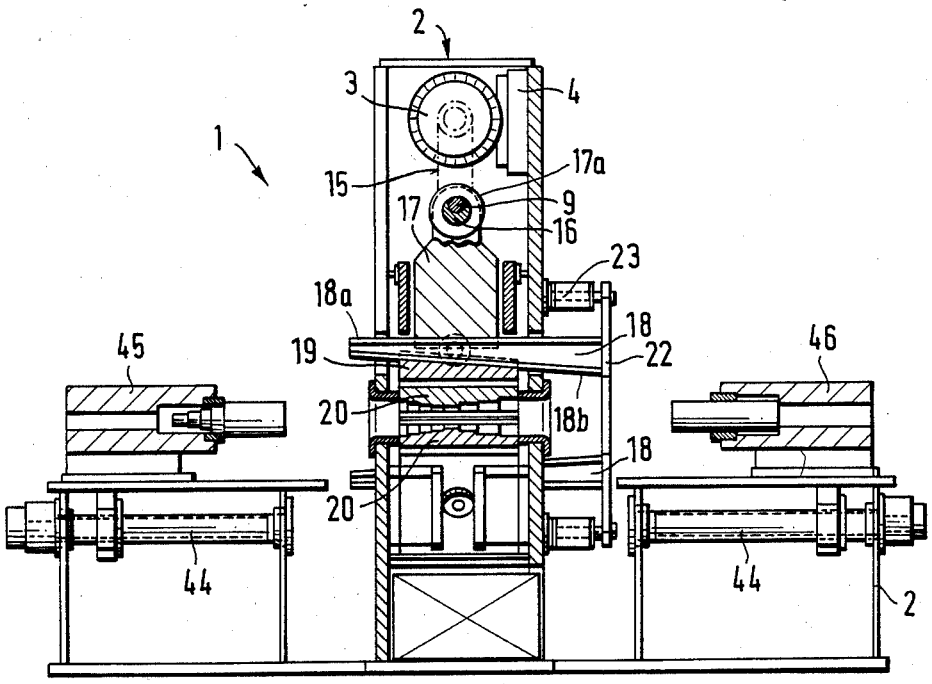
FIG. 2 is a sectional view along line II—II of FIG. 1.

The high-speed hammer drop forging machine, generally designated 1, of FIGS. 1 and 2 has an upright housing 2 containing four driving motors 3 such as electromotors disposed on support stands 4. Driving motors 3 act on a common angular gear unit, generally designated 5, consisting of shafts 6, 7, 8, 9 and 10 and bevel gear sets 11, 12, 13 and 14. Transmission agents 15, such as drive belts, connect shafts 6–10 to the driving shafts of electromotors 3 so that all the drives are synchronized.

The drives act via shafts 6–10 on eccentrics 16 mounted in coupling portions 17*a* of hammers 17. Thus, as shafts 6–10 rotate, eccentrics 16 cause hammers 17 to move in and out with respect to each other.

Shifting wedges 18 connect hammers 17 to the swage or tool supports 19 upon which swage portions 20 are mounted. Depending on the position of eccentrics 16, all swage portions 20 can be actuated simultaneously or the pair of two swage portions 20 standing diagonally opposite with respect to each other, can be actuated together and in succession in terms of time with respect to the pair of two other swage portions 20 lying diagonally, that is, in a diagonally reciprocal manner. The two pairs of swage portions 20 as shown are positioned along axes which are perpendicular with respect to each other.

Hydraulic cylinders 23 actuate sliding wedges 18 via a holding support 33. Thus, delivery of the tool supports 19 with swage portions 20 can be affected in a corresponding manner. That is, the tool supports 19 will move in and out with respect to the hammers 17 depending upon the disposition of the sliding wedges 18.

Sliding wedges 18 advantageously have a cone section which guarantees automatic stoppage of, for example, 10%. Flange portions 18*a* and 18*b* of wedges 18 slidingly connect to hammers 17 and tool supports 19, respectively. Thus, as the wedges 18 move up and down, hammers 17 and tool supports 19 move in and out with respect to each other. Sliding wedges 18 advantageously have a length which corresponds to at least the length of the swage portions 20 including a multiple of the maximum depth of infeed at the swage. Reliable delivery of swage portions 20 can thereby be achieved.

Hammers 17 are mounted together with tool supports 19, in which they glide, in such a way that they can occupy an inclined position in accordance with the settling of the eccentric 16 inside the housing of the machine. The forming areas of swage portions 20 are advantageously dimensioned in the peripheral direction in each case so that they are so great that they overlap a little with the forming areas of, in each case, adjacent swage portions 20.

Figure 6:
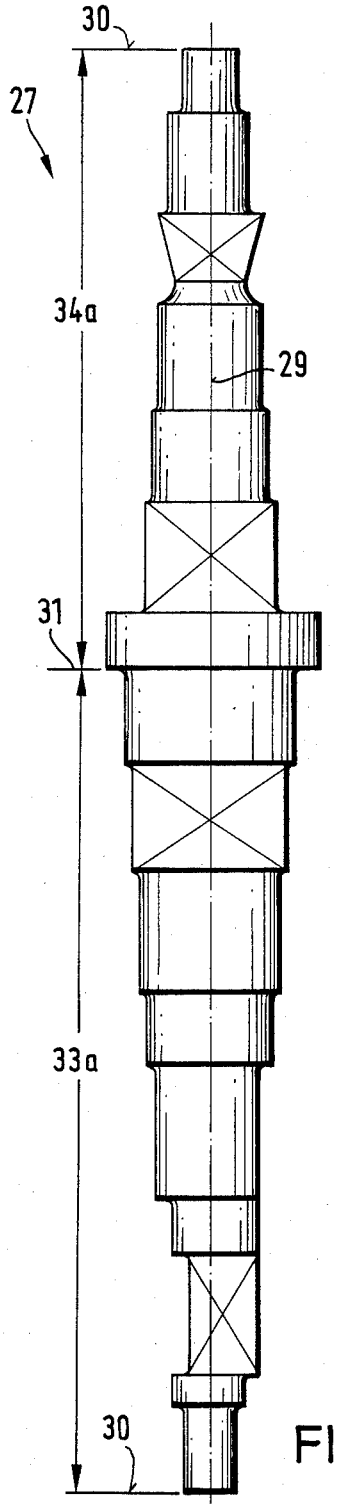
Figure 7:
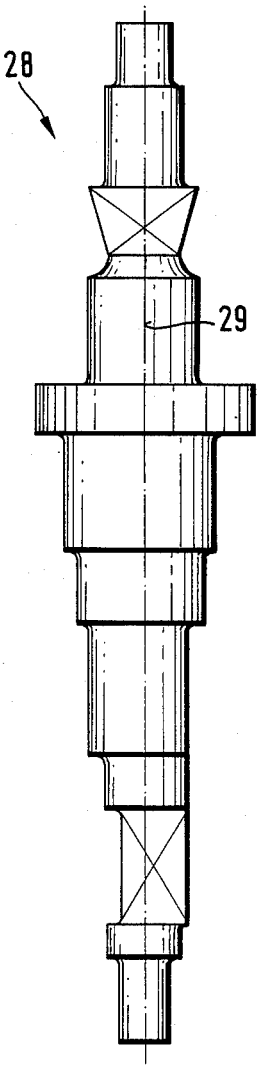

The assembly of the invention can produce work-pieces 27 and 28 shown in FIGS. 6 and 7. Work-pieces 27 and 28 are subdivided into a plurality of different cross-sectional areas including rectangular and round cross-sections and cross-sections which are partially symmetrical and partially unsymmetrical with respect to the longitudinal axis 29.

Cooperating swage portions 20 shown in FIG. 4, are imaginarily subdivided into two different forming areas having a boundary found in the transverse plane represented by the dot-dash line 30. This transverse plane for the example of FIG. 6, to which swage portions 20 of FIG. 4 correspond, corresponds to the transverse planes 30 at the ends of work-piece 27. With swage portions 20 cooperating in accordance with FIG. 4, the forming areas 33 and 34 result with regard to the transverse plane 30. With the corresponding work-piece of FIG. 6, the work-piece areas 33*a* and 34*a* develop with regard to the transverse plane 30.

The cooperating swage portions 20 are constructed with their engravings in such a way that with regard to a predetermined transverse plane 30 inside the whole longitudinal area reciprocally area portion 33 of swage 20 before the transverse plane 30, corresponds to the form of the work-piece area 33*a* after the transverse plane 31 and the swage area portion 34 after the transverse plane 30 corresponds to the form of the area 34*a* of the work-piece 27 before the transverse plane 31.

The forming areas 33 and 34 of tool swage portions 20 are shifted reciprocally with respect to each other in the longitudinal axis with respect to the work-piece areas 33*a* and 34*a*. The position of the transverse plane depends on the shape of the work-piece to be produced. The greatest diameter or the greatest cross-section of the work-piece will be used advantageously as a basis for the division at the swage so that it is possible to forge in an axial direction in a reducing manner. FIG. 7 illustrates another embodiment of a work-piece 28.

Figure 5:
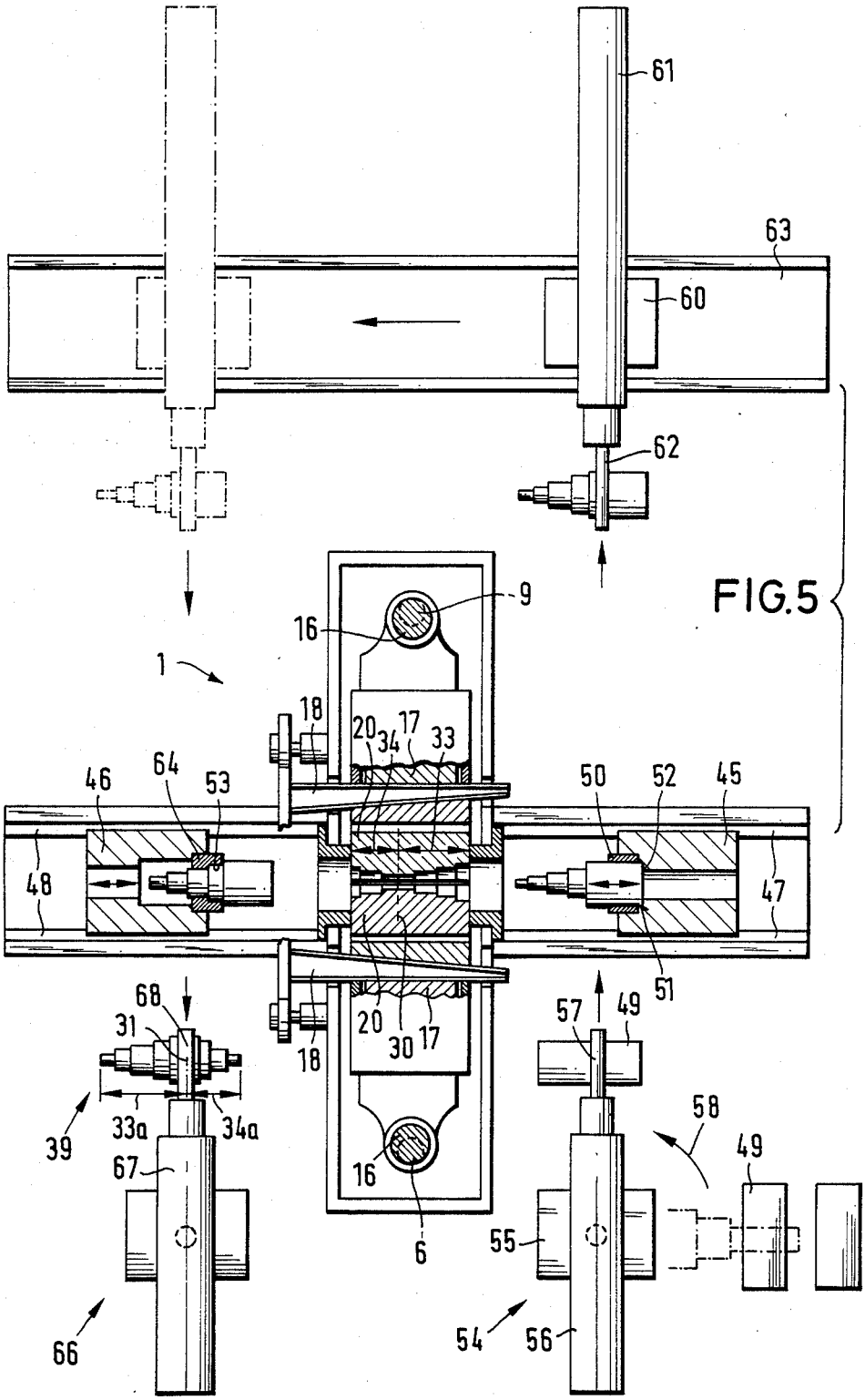
FIG. 5 is an elevational view partially in section of an embodiment of the assembly used to effect the method for forging a slug according to the invention.

In FIG. 5, swage portions 20 for producing a finished work-piece 39 are shaped with comparatively simple profiling. Because of the imaginary transverse plane 30 provided at the swage, the forming areas 33 and 34 result at the swage. Thus, portions 33 and 34 of the swage produce corresponding areas 33*a* and 34*a* on work-piece 39, respectively, with respect to the transverse plane 31.

Guide slides 45 and 46 are located on the opposite outside faces of swage portions 20. Guide slides 45 and 46 hold the material to be processed in swage portions 20 and can be shifted longitudinally with respect to the swage in a to-and-fro motion as shown by the double arrows. Spindle drive 44 are disposed along the slide ways 47 and 48 and are connected to guide slides 45 and 46 for effecting the to-and-fro movement.

A slug 49 is plugged in through a clamping ring 50 into a corresponding bore hole 51 as far as stop 52 located on slide 45. Movement of slide 45 is subsequently controlled so that the work-piece area 33*a* is forged through the area 33 of the swage portions 20.

Device, generally designated 54, supplies slug 49 with an arm 56 pivoted on a stand 55 and having a gripping device 57. In the swung-off position as shown in the dot-dash line of FIG. 5, slug 49 is grasped. Then, arm 56 is swung through a 90° arch according to arrow 58 and is moved into position for placing the slug 49 into the slide 45. That is, slug 49 is plugged into slide 45 as far as stop 52 by advancing the slide 45. Once the arm 56 is retracted, slide 45 moves on with slug 49 to forge area 33*a* of the work-piece. The partially forged work-piece is then withdrawn from between the swage portions 20 as formed in the swage area portion 33.

The partially formed work-piece is then grasped by gripping device 62 of arm 61 mounted on a transfer or transport slide 60. Transport slide 60 is movably mounted on a guideway 63 and serves to guide the partially forged work-piece onto the other side of swage portions 20. The position of the transport slide 60 on the opposite side of the swages 20 is shown in dot-dash lines.

The partially processed slug 49 is then advanced into the position for insertion into the guide slide 46. Supporting arm 61 is reciprocatingly mounted on slide 60 to effect the movement into and out of position for removing the partially completed slug 49 from slide 45 and then inserting the same plug into position for insertion into the guide slide 46. In the first instance, gripping device 62 grasps the partially formed slug 49 while still inserted in slide 45 which is then simply drawn back so that the slug becomes free. Transport slide 60 is then moved on the guideway 63 with supporting arm to the other side of the forging machine 1 as shown.

As noted, in the dot-dash position, the partially finished work-piece comes to lie before the clamping sleeve 64 after the arm 61 has been advanced to put the slug into position. Slide 46 is now driven so that the work-piece clamped therein is plugged up to stop 53 located in clamping sleeve 64. Guide slide 46 is then advanced toward swage portion 20 where the work-piece is finished in the work-piece area 34*a* using the swage area 34 within the swage portion 20 of the forging machine 1.

A finished work-piece removing device, generally designated 66, has an arm 67 with a gripping device 68 which may be advanced to the point in front of the guide slide 46. There, the finished work-piece is grasped at the greatest diameter by the gripping device 68. Slide 46 is then drawn further back so that the work-piece comes free from its holding support and slide. Arm 67 is then drawn back. Gripping device 68 is opened and the finished work-piece can be removed by hand or by automatic means. The portion of the slug remaining unforged is advantageously forged during the forging of the first partial piece of a slug newly supplied on the other side of the same swage portions 20.

The drop forging machine is advantageously a high-speed hammer machine. While effecting the forging press, sliding wedges 18 may be adjusted in accordance with the variation in form or volume as occurs at the swage portions 20. In each case, this adjustment is effected in such a way that the distance of the swage portions 20 standing opposite each other to the longitudinal central axis is reduced by the desired amount. During a forging process, the actual working stroke remains unchanged. The change in stroke position, effected by the wedges, renders possible undercuts on the work-piece. Before being inserted into the machine, slugs are brought up to the required forging temperature by some form of heating such as inductive heating.

While the method and device for forming work-pieces by drop forging have been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A method for forging work-pieces by drop forging in a swaging area, said method comprising the steps of:

(a) providing a blank having a given volume of material corresponding at least to the volume of the work-piece to be produced, (b) providing a swage including cooperative swage portions having a longitudinal axis and with a length corresponding at least to the length of said work-piece and having forming area sections which extend in opposing axial directions with respect to a predetermined transverse plane intersecting said longitudinal axis within said length of the swage portions, said axially opposing forming area sections of each swage portion being coextensive with one another, (c) gripping the blank at an intermediate point between its ends to provide free end portions ready for insertion into a first forming area section of the swage, (d) feeding a first one of the free end portions of the blank into the first forming area section of the swage, (e) forging said first free end portion of the blank with the swage portions while gripping the blank at said intermediate point, (f) removing the forged free end portion of the blank from the first forming area section of the swage after the forging step and again gripping the blank at an intermediate point between its ends, transporting the other unforged free end portion of the blank in the axis of the other side of the swage portion, (g) introducing the other unforged, second free end portion of the blank into a second forming area section which extends in an opposing axial direction at the opposite end of the same swage portion, while the blank is kept gripped at an intermediate point between the ends, (h) forging the second free end portion of the blank with the swage portions while gripping the blank at said intermediate point thereby producing a finished workpiece having a shape along its entire length produced by the forming area sections of said swage, and (i) removing said finished work-piece from the second forming area section after forging the free ends of the blank and again gripping the blank and transporting it out of the swaging area.

2. A method as defined in claim 1 wherein the portion of the blank remaining unforged is forged during the forging of the first partial piece of a further blank newly supplied on a first operational side of the swage.

3. A method as defined in claim 1 wherein each of the free end portions of the blank are moved in an axial direction of the blank during the feeding and introducing steps.

4. A method as defined in claim 3 wherein the blank is moved in a direction transverse to its axial direction for positioning in front of the swage before insertion therein and after removal therefrom.

5. A method as defined in claim 1 wherein each of the free end portions of the blank are moved in an axial direction of the swage during the removing steps.

* * * * *